US006021897A

United States Patent [19]

Sutherland

[11] Patent Number: 6,021,897

[45] Date of Patent: Feb. 8, 2000

[54] WRAP-AROUND ARTICLE CARRIER

[75] Inventor: Robert L. Sutherland, Kennesaw, Ga.

[73] Assignee: Riverwood International Corporation, Atlanta, Ga.

[21] Appl. No.: 09/243,987

[22] Filed: Feb. 3, 1999

[51] Int. Cl.[7] ..... B65D 65/10; B65D 5/50

[52] U.S. Cl. ..... 206/427; 206/196; 206/434; 229/117.13

[58] Field of Search ..... 206/427, 429, 206/433–435, 140, 193, 196; 229/117.13, 117.16, 132, 137

[56] References Cited

U.S. PATENT DOCUMENTS

| | | | |
|---|---|---|---|
| 2,911,136 | 11/1959 | Stone | 229/117.13 |
| 2,990,997 | 7/1961 | Weiss | 206/434 |
| 4,164,286 | 8/1979 | Sutherland | 206/434 |
| 4,216,861 | 8/1980 | Oliff | 206/427 |
| 4,482,090 | 11/1984 | Milliens | 229/117.13 |
| 4,785,991 | 11/1988 | Schuster | 206/427 |
| 4,941,624 | 7/1990 | Schuster | 229/117.13 |
| 5,002,186 | 3/1991 | Cooper | 206/433 |
| 5,221,042 | 6/1993 | Oliff | 229/117.13 |
| 5,292,059 | 3/1994 | Oliff | 229/137 |

*Primary Examiner*—Bryon P. Gehman

[57] ABSTRACT

A wrap-around article carrier, comprising a bottom panel having opposing side edges and further having opposing end edges, a first side panel and an opposing second side panel, and a top panel having opposing side edges. Each one of the side panels has a top edge and an opposing bottom edge that is connected to one of the side edges of the bottom panel. The side edges of the top panel are connected to one of the top edges of the side panels. The carrier further has a first end panel and an opposing second end panel. Each of the end panels has a bottom edge that is connected to one of the end edges of the bottom panel. The carrier further has an article holder connected to the top panel. The article holder contacts and secures the top of articles contained within the carrier.

29 Claims, 7 Drawing Sheets

WRAP-AROUND ARTICLE CARRIER

BACKGROUND OF THE INVENTION

1. Field of the Invention.

The present invention relates, generally, to article carriers. More particularly, the invention relates to wrap-around article carriers formed by wrapping a flat carrier blank around a product configuration.

2. Background Information.

Wrap-around article carriers are commonly used to package beverage cans and other articles. Basically, wrap-around article carriers are formed by grouping articles in an arrangement they are desired to be in after packaging to form a product configuration, then wrapping a flat carrier blank around the product configuration. The blank is tightly drawn about the articles and the ends of the blank are connected to each other. Cutouts are often provided at the upper and lower portion of the side panels in order to grip the end portions of articles protruding through the cutouts. The cutouts allow the blank to be tightly wrapped around and to securely hold the product group. Wrap-around article carriers are economical to make and use because they typically use a smaller amount of paperboard than other cartons, and because they are stored and transported as a flat carrier blank rather than as a carton sleeve. Furthermore, wrap-around article carriers are sturdy and are well-accepted by the public.

The state of the art is believed to have limitations and shortcomings. Wrap-around article carriers by their nature have been limited as to the number of articles they can hold before articles will spill out of the open ends of the article carrier. Normally, articles are arranged in two adjacent rows, so that the sides of the carrier engage the outer portions of all of the articles in each row while the inner portions of the articles in the rows abut against each other. The end portions of the articles extend through the cutouts in the side panel, which prevent the articles from spilling through the open ends of the carrier. If three rows of articles were to be packaged in one of these wrap-around article carriers, the articles in the middle row would not be in contact with the wrapper, but would be held in place only by the pressure exerted by adjacent articles in the adjacent outer rows. Attempting to package a three-row product group using a typical known wrap-around article carriers increases the risk of the articles spilling out through the open ends of the carrier. Because these type of wrap-around article carriers normally can accommodate only two rows of articles, the number of articles that can be packaged is governed to a large extent by the desirable length of the package. Packages containing six articles are the most common, although packages containing eight articles can also be conveniently handled. Depending on the size of the articles, packages containing more than eight articles are not convenient to handle.

U.S. Pat. No. 5,611,4311, assigned to Applicant's assignee, shows a wrap-around article carrier for packaging three rows of articles. The '431 carrier is capable of conveniently packaging large numbers of articles, including product configurations of up to twenty-four. A separate reinforcement strip having clip-type support panels is glued to the underside of the top panel of the carrier. These support panels support the articles of the middle row and prevent the end articles from spilling through the open ends of the carrier. The reinforcement strip also helps form a two-ply handle for the carrier.

Applicant's invention provides a wrap-around article carrier which is believed to constitute an improvement over the existing technology.

BRIEF SUMMARY OF THE INVENTION

The present invention provides a wrap-around article carrier which generally comprises opposing side panels foldably connected to both a bottom panel and a top panel. Opposing end panels are likewise foldably connected to the bottom panel and are further attached to the side panels via comer tabs on the end panels. The height of the opposing end panels is preferably less than the height of the side panels. The side panels have a top margin or bevel portion formed by a score line, and further have cutouts in the side panels to help secure the articles in the carrier. The top panel of the carrier is formed from a glue or first top panel and a second top panel. The second top panel overlaps and is attached to the first top panel. An article holder is attached or connected to one of the top panels. The article holder is configured to contact and help secure the top of at least one of the articles in the carrier. The end panels, the cutouts, and the article holder work together to hold the articles within the carrier, and thus allow the carrier to hold larger product configurations.

In one embodiment of the wrap-around article carrier, the article holder comprises a number of chimes positioned in a lock flap formed by a fold line in the first top panel. The chimes are preferably formed from semi-circular openings in the lock flap that are sized to receive the chime or flange of a beverage can. The lock flap is clipped, and the first top panel and the lock flap are folded over the articles until the tops of the articles extend through the chimes. This embodiment is particularly well-adapted to secure the center row of a 3×4 product configuration of beverage cans, wherein the lock flap has four chimes that clip around the top flange of the four beverage cans in the center row.

In another embodiment of the wrap-around article carrier, the article holder comprises a number of chimes positioned in a v-clip lock flap formed by a first fold line in the glue or first top panel. The v-clip lock flap comprises a first bevel panel and a second bevel panel. Each bevel panel has chimes allowing the v-clip lock flap to secure article tops in adjacent rows. The v-clip lock flap is clipped, and the first top panel and the v-clip lock flap are folded over the articles until the article tops in two adjacent rows extend through the chimes in the bevel panels. This embodiment is well-adapted to secure an outside row and the middle row of a 3×4 product configuration of beverage cans, wherein each bevel panel has four chimes that clip around the flange of the beverage cans in the two adjacent rows. This embodiment is also well-adapted to secure the two middle rows of a 4×6 product configuration of beverage cans, wherein each bevel panel has six chimes that clip around the flange of the beverage cans in the two adjacent middle rows.

In another embodiment of the wrap-around article carrier, the article holder comprises a can clip having a strap and two opposite bevel panels. Opposing pairs of chimes are positioned in the bevel panels. The can clip is placed on a row of articles allowing the top of the articles to extend through the chimes. The strap of the can clip is glued or otherwise attached to the first top panel when it is folded over the article group. This embodiment is particularly well-adapted to secure the middle row of a 3×4 product configuration of beverage cans, wherein the can clip has four opposing pairs of chimes that clip around the top flange of the beverage cans in the center row.

In another embodiment of the wrap-around article carrier, the article holder comprises two tabs formed in the second top panel. The tabs fold downward into the carrier and contact articles within the product configuration. This embodiment is particularly well-adapted to secure a 2×3 product configuration of beverage cans, wherein both tabs extend between the two rows of cans. One of the tabs extends between the first and second column of cans, and the other extends between the second and third column of cans.

The wrap-around article carrier of the present invention includes an article holder and end panels for securing articles within the carrier. The article holder is preferably formed as a unitary structure with the flat carrier blank, but may be a separate structure attached to the top panel.

The features, benefits and objects of this invention will become clear to those skilled in the art by reference to the following description, claims and drawings.

DETAILED DESCRIPTION

Figure 1:
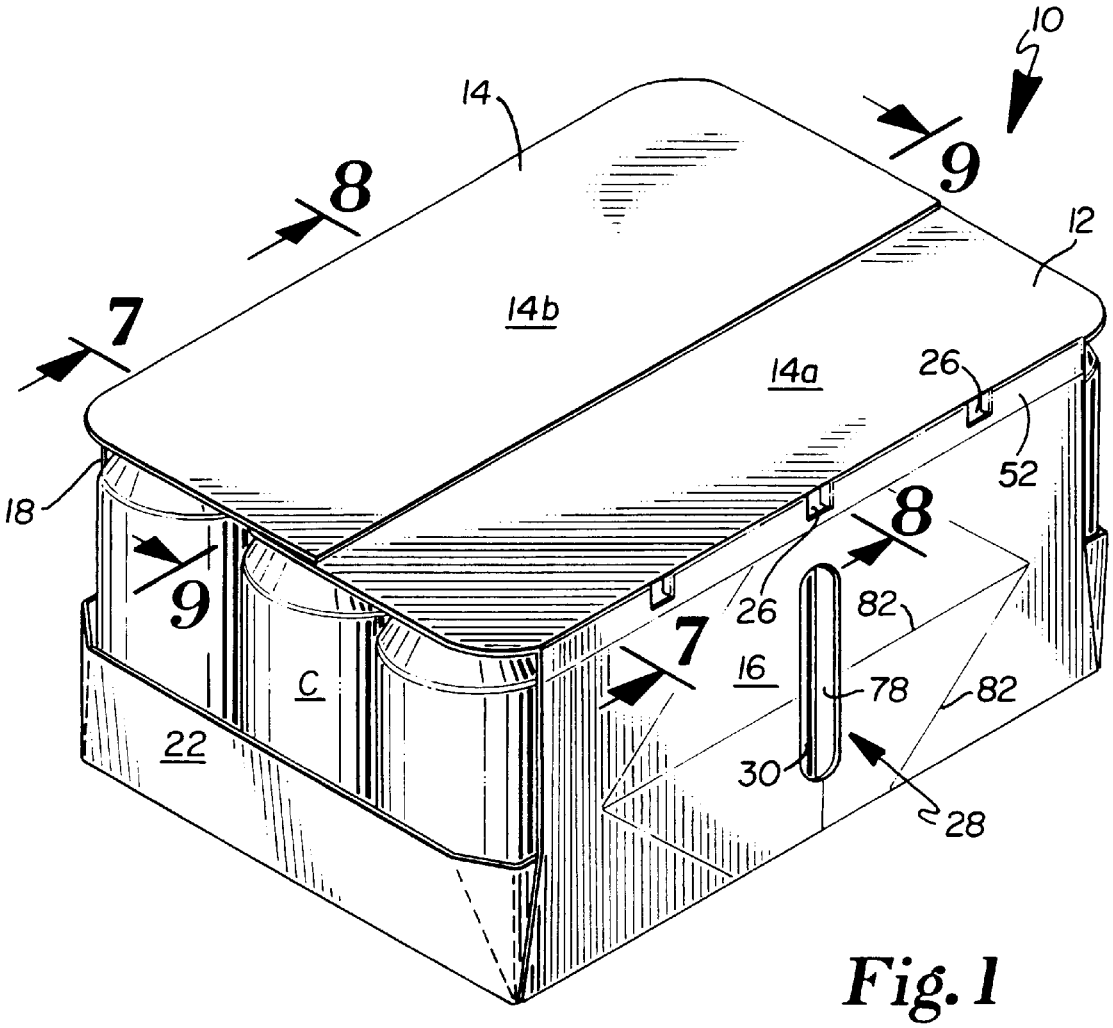
FIG. 1 is a perspective view of an embodiment of a wrap-around article carrier of the present invention.
Figure 9:
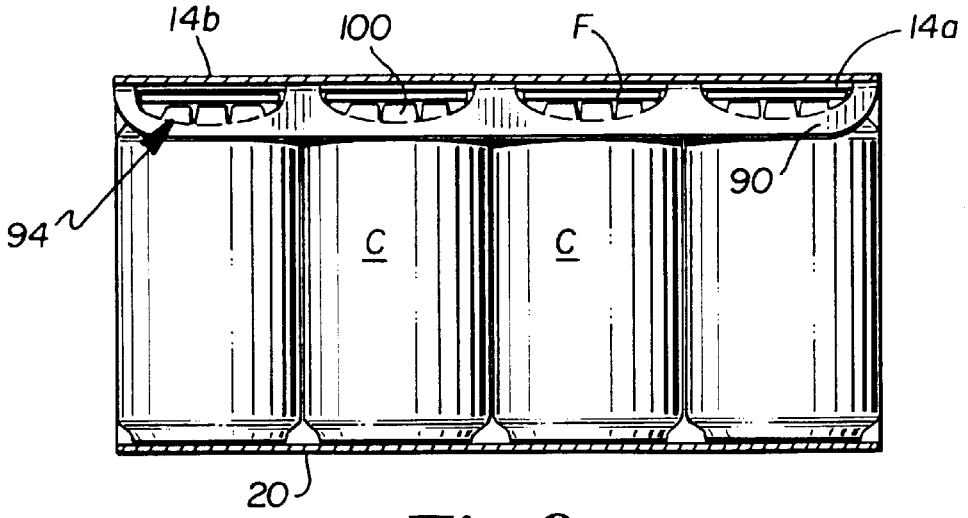
FIG. 9 is a partial cross-sectional view taken along line 9—9 of FIG. 1.

Referring to FIG. 1, a package 10 is comprised of a wrap-around article carrier 12 and twelve beverage cans C contained within the carrier. The twelve cans form a product configuration of three adjacent rows by four adjacent columns. The carrier 12 includes a top panel 14 connected to side panels 16 and 18, which in turn are connected to a bottom panel 20, shown in FIG. 9. The carrier 12 further includes end panels 22 and 24 that are connected to the bottom panel 20 and to the side panels 16 and 18. Cutouts 26 in the upper portion of the side panels 16 and 18 are located between adjacent columns of the cans.

Figure 2:
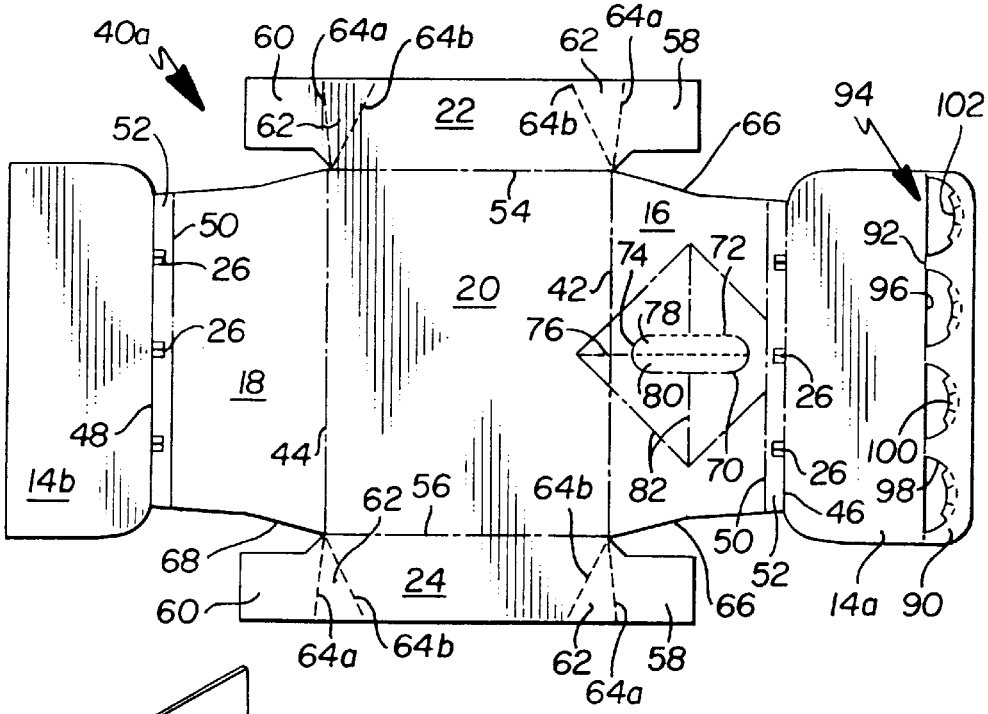
FIG. 2 is a plan view of a blank for forming the main wrap-around portion of the carrier of FIG. 1.

Referring to FIG. 2, a primary blank 40*a* for forming the wrap-around article carrier 12 shown in FIG. 1 is a generally rectangular sheet of paperboard or other material having sufficient strength and flexibility to be folded into place and function as a carrier. Bottom panel section 20 is connected by fold line 42 to side panel section 16 and by fold line 44 to side panel section 18. The side panel section 16 is connected to a glue or top panel flap 14*a* by fold line 46, and the side panel section 18 is connected to a top panel flap 14*b* by fold line 48. The top panel flap 14*b* overlaps and is glued to the top panel flap 14*a* to form the top panel 14 shown in FIG. 1. Fold lines 50 are spaced a short distance from fold lines 46 and 48 to form bevel panel sections or top margins 52. The cutouts 26 are formed within the margins 52. The cutouts 26 are preferably formed by an I-shaped cut to form two tabs that fold about vertical lines into the carrier 12 and away from each other. The cutouts 26 on each side panel are spaced at intervals along the margins 52 that allow the tabs to extend between adjacent columns of cans C and help secure the cans within the carrier. The top margins 52 allow the side panels 16 and 18 to conform to the shape of the top of the cans, particularly when the carrier 12 is undergoing lifting stresses.

The bottom panel section 20 is connected to an end panel flap 22 by fold line 54 and to an end panel flap 24 by fold line 56. A first tab 58 and an opposing second tab 60 are foldably connected to the end panel flaps 22 and 24 via triangular bevel portions 62, each of which is defined by fold lines 64*a* and 64*b*. The first tab 58 and bevel portions 62 are configured to attach to the side panel 16 and the second tab 60 and bevel portions 62 are configured to attach to the side panel 18 in a formed carrier 12. The height of the end panels is preferably between ¼ and ½ the height of the side panels. The side panels have opposing end edges 66, each of which have an angled portion 68. The angled portion 68 of the end edge 66 is positioned and oriented to align with the fold line 64*a* between the bevel portions 62 and the corner tabs 58 and 60 in an assembled carrier 12. This design provides paperboard savings.

A handle 28 is formed by creating an opening 30 in the side panel section 16. The opening 30 is defined by a perforated edge 70 and a fold line 72 which create a tab 74 that folds into the carrier. A score line 76 dissects the tab 74 into a beveled portion 78 and a distal portion 80, and extends a short distance into the bottom panel section 20. The beveled portion 78 and distal portion 80 of the tab 74 follow the cylindrical contour of a can in the carrier. The side panel section 16 has a pattern of stress-reducing score lines 82 which extend a short distance into the bottom panel section 20. These score lines 82 distribute the stresses that occur when the package 10 is lifted by the handle 28.

Figure 3:
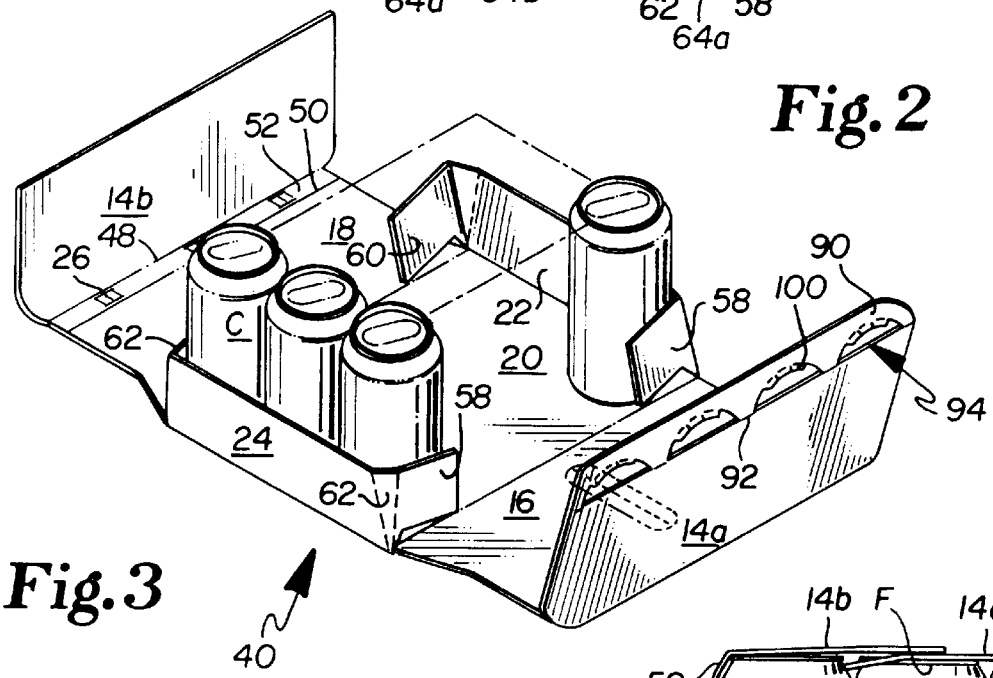
FIG. 3 is a perspective view illustrating the blank of FIG. 2 being folded around an article group.

As shown in FIGS. 2 and 3, a lock flap 90 is connected to the top panel flap 14*a* by fold line 92. The lock flap 90 contains can lock chimes 94 and forms an article holder for contacting and supporting the tops of the cans within the carrier 12. The can lock chimes 94 are semi-circular openings defined by a diametric edge 96 along fold line 92 and a peripheral edge 98. The peripheral edge 98 is cut and scored in a manner to form tabs 100 opposite from the diametric edge 96. These tabs 100 fold along the peripheral edge 98 and have curved interior edges 102 that conform to the shape of a chime or flange F of a can C. The chimes 94 are sized and arranged to fit over the top of the cans C in the carrier 12 when the lock flap 90 is folded or clipped over the cans. As shown in greater detail in FIG. 9, the tabs 100 slide over and engage or lock with the flange F of a can C, thus holding or stabilizing the top of the can C within the carrier 12. The chimes engage the article tops in the middle row of a three row by four column product configuration.

Figure 6:
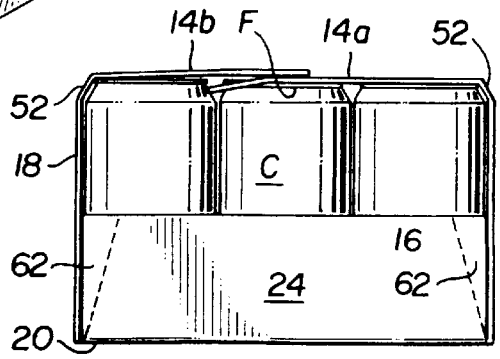
FIG. 6 is an end view of the wrap-around article carrier of FIG. 1.
Figure 5:
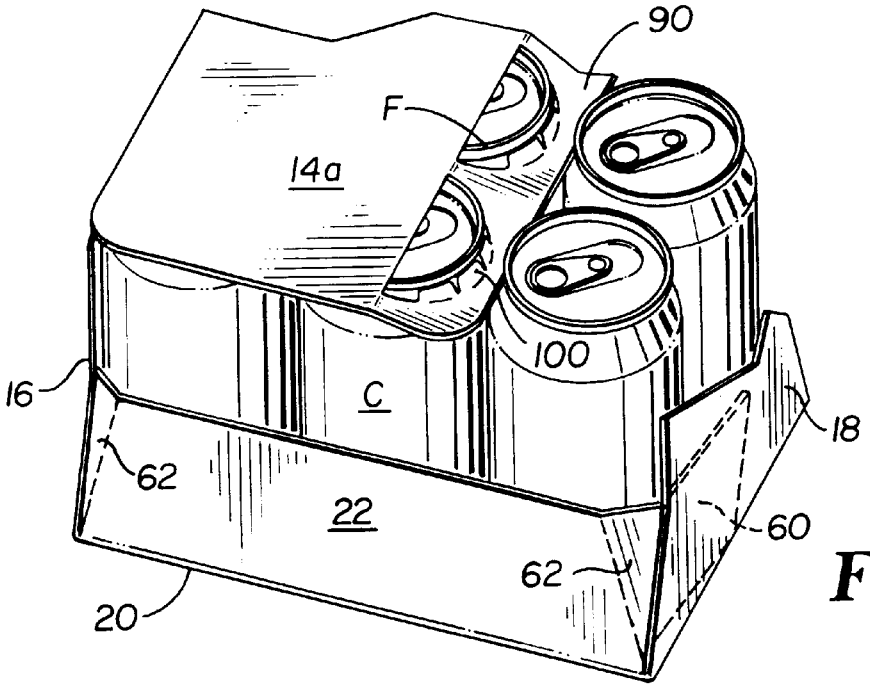
FIG. 5 is a partial perspective view of the wrap-around article carrier of FIG. 1.
Figure 7:
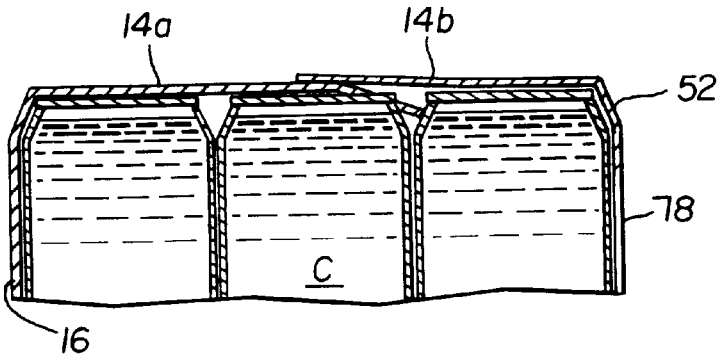
FIG. 7 is a partial cross-sectional view along line 7—7 of FIG. 1.
Figure 8:
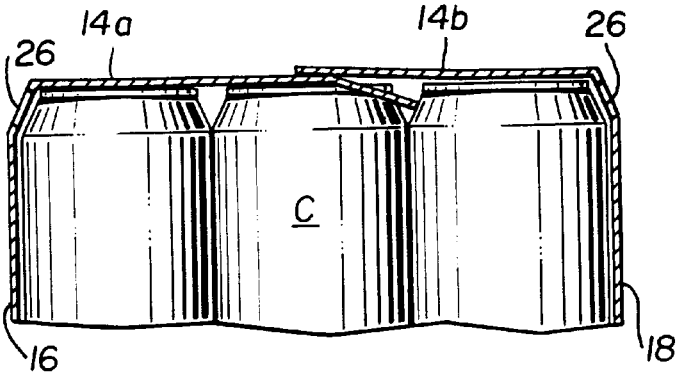
FIG. 8 is a partial cross-sectional view taken along line 8—8 of FIG. 1.
Figure 4:
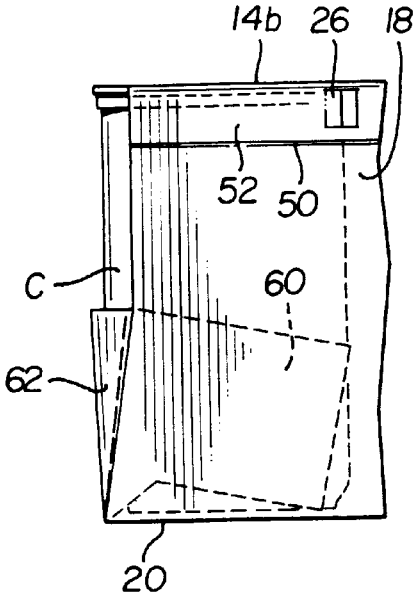
FIG. 4 is a partial end view of the wrap-around article carrier of FIG. 1.

To form a package 10 from the blank 40*a*, twelve beverage cans are arranged into a product configuration comprising three rows and four columns as illustrated in FIG. 3. The cans are positioned on the bottom panel section 20. The blank 40 is schematically shown in FIG. 3 as being positioned in a partially folded condition. The end panels 22 and 24 are folded upward and the corner tabs 60 and 58 are folded inward, then the side panels 16 and 18 are folded upward and glued to the tabs 58 and 60 to form all four bottom corners as illustrated in FIG. 4. The top panel 14*a* is folded over the cans C and the lock flap 90, which forms the article holder, is further folded to cause the can lock chimes 94 to extend around a portion of the flanges of the cans in the center row as illustrated in FIG. 5. The top panel 14*b* is folded over and glued onto the top panel 14*a* to compete the construction of the carrier 12 as illustrated in the end view of FIG. 6 and the cross-sectional views of FIGS. 7 and 8.

Figure 11:
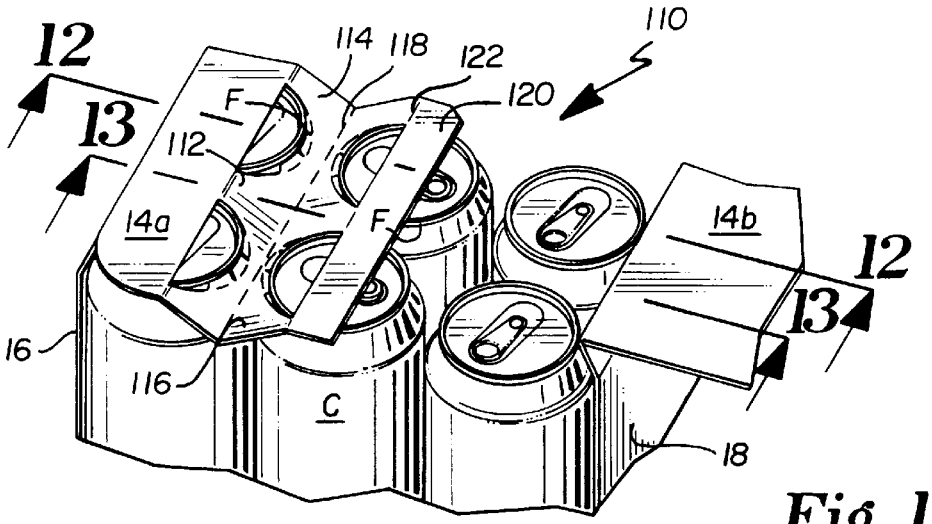
FIG. 11 is a partial perspective view of the wrap-around article carrier formed by the blank of FIG. 10.
Figure 10:
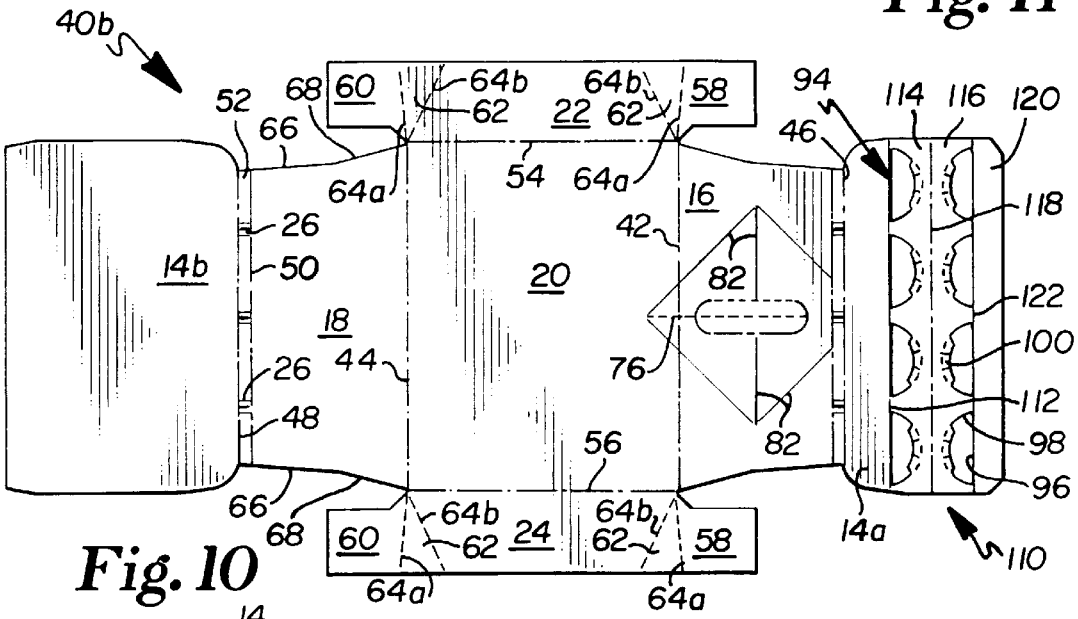
FIG. 10 is a plan view of a blank for forming the main wrap-around portion of another embodiment of the wrap-around article carrier of th e present invention.
Figure 12:
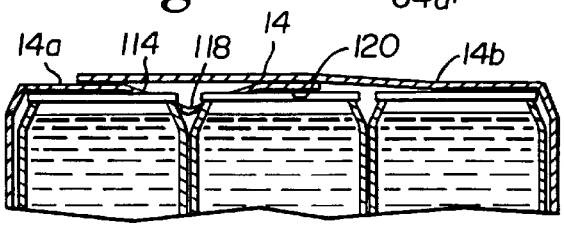
FIG. 12 is a partial cross-sectional view taken along line 12—12 of FIG. 11.
Figure 13:
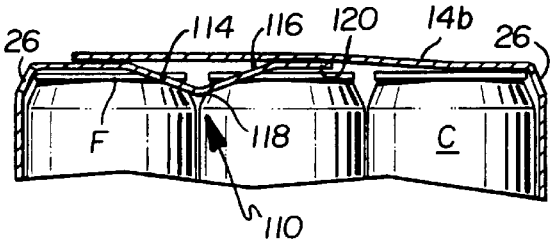
FIG. 13 is a partial cross-sectional view taken along line 13—13 of FIG. 11.
Figure 14:
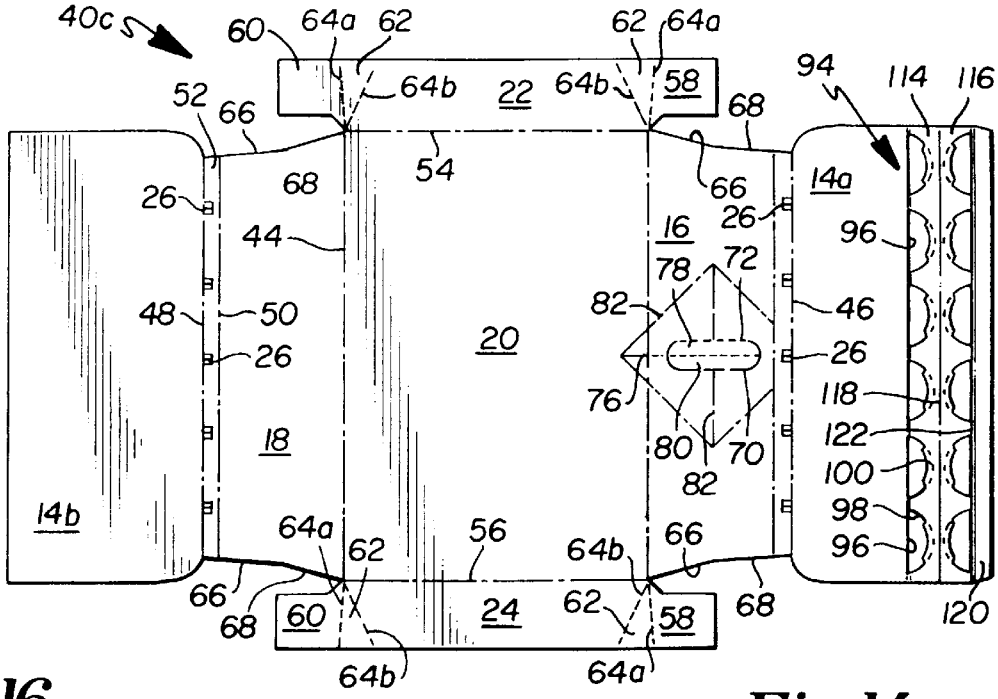
FIG. 14 is a plan view of a blank for forming the main wrap-around portion of another embodiment of the wrap-around article carrier of the present invention.
Figure 15:
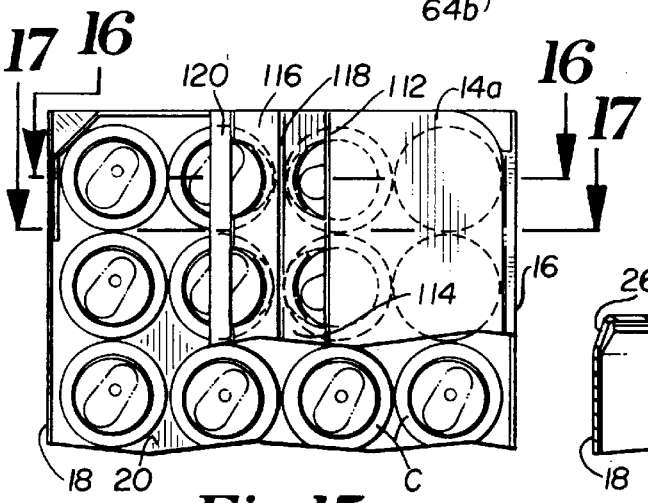
FIG. 15 is a partial top view of a partially assembled wrap-around article carrier formed from the blank of FIG. 14.
Figure 17:
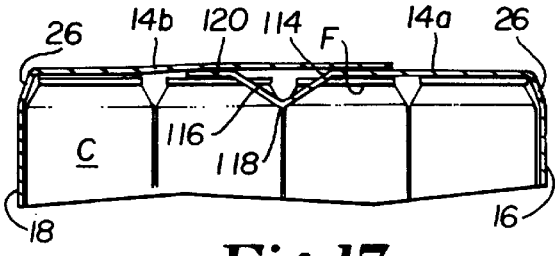
FIG. 17 is a partial cross-sectional view of a partially assembled wrap-around article carrier taken along line 17—17 of FIG. 15.
Figure 16:
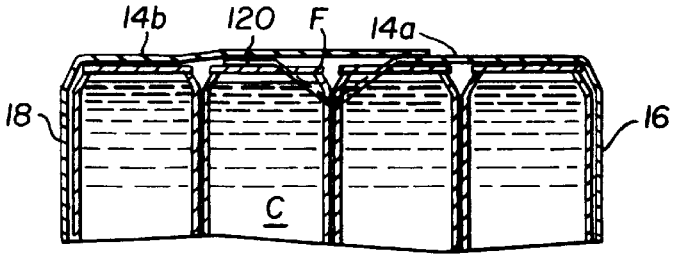
FIG. 16 is a partial cross-sectional view of an assembled wrap-around article carrier taken along line 16—16 of FIG. 15.

The flat carrier blank 40*b* of FIG. 10 and the views of FIGS. 11–13 illustrate another embodiment of the wrap-around article carrier of the present invention. A v-clip lock flap 110 forms an article holder for contacting and supporting two adjacent rows of articles within the carrier 12. The v-clip lock flap 110 includes a first bevel portion 114 connected to the top panel flap 14*a* by fold line 112, a second bevel portion 116 is connected to the first bevel portion 114 by fold line 118, and a distal panel 120 is connected to the second bevel portion 116 by fold line 122. The v-clip lock flap 110 contains can lock chimes 94 positioned in the bevel portions 114 and 116. The can lock chimes 94 are semi-circular openings defined by a diametric edge 96 along fold line 112 and 122 and a peripheral edge 98. The peripheral edge 98 is cut and scored in a manner to form tabs 100 opposite from the diametric edge 96. These tabs 100 fold along the peripheral edge 98 and have curved interior edges 102 that conform to the shape of a chime or flange F of a can C. The chimes 94 are sized and arranged to fit over the top of the cans C in the carrier 12 when the lock flap 90 is folded or clipped over the cans. Opposing chimes 94 within the bevel portions engage adjacent cans in the two adjacent rows nearest to the side panel 16 in a three row by four column product configuration. A similar embodiment is illustrated by the blank 40*c* of FIG. 14 and the views of FIGS. 15–17. Fold line 112 is spaced further away from the fold line 46 in order to extend the v-clip lock flap 110 further away from the side panel 16 and to engage the middle two rows of article tops in a four row by six column product configuration.

Figure 18:
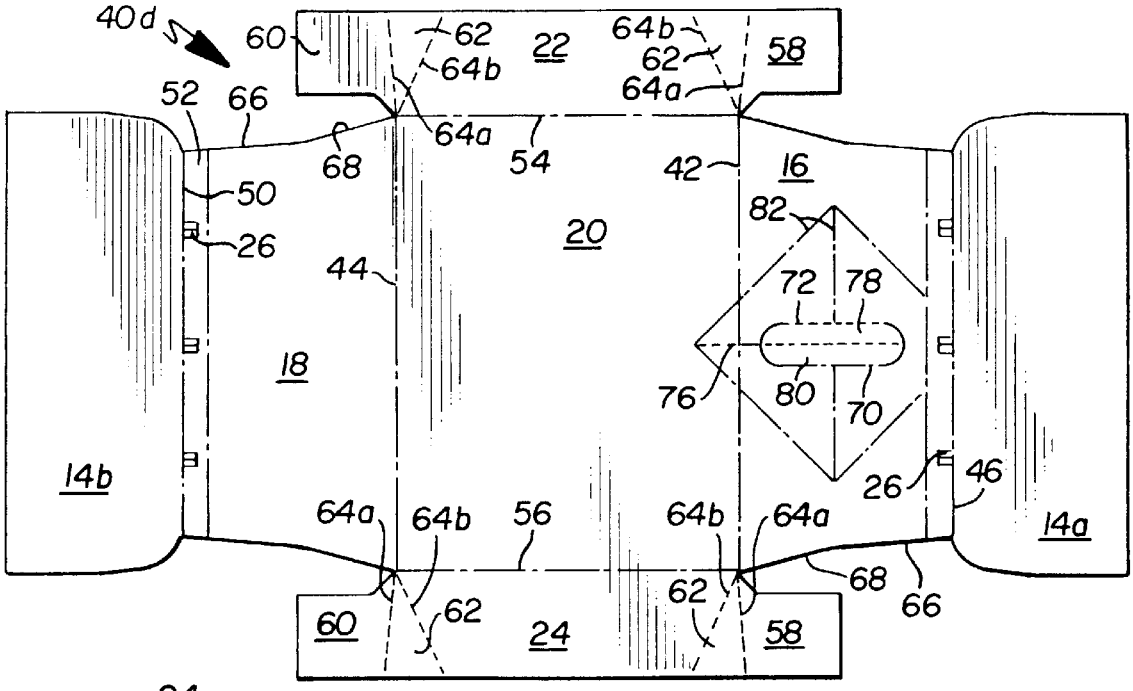
FIG. 18 is a plan view of a blank for forming the main wrap-around portion of another embodiment of the wrap-around article carrier of the present invention.
Figure 19:
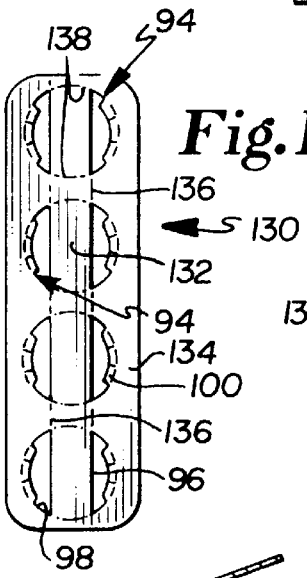
FIG. 19 is a bottom plan view of a can clip used with the blank of FIG. 18.
Figure 20:
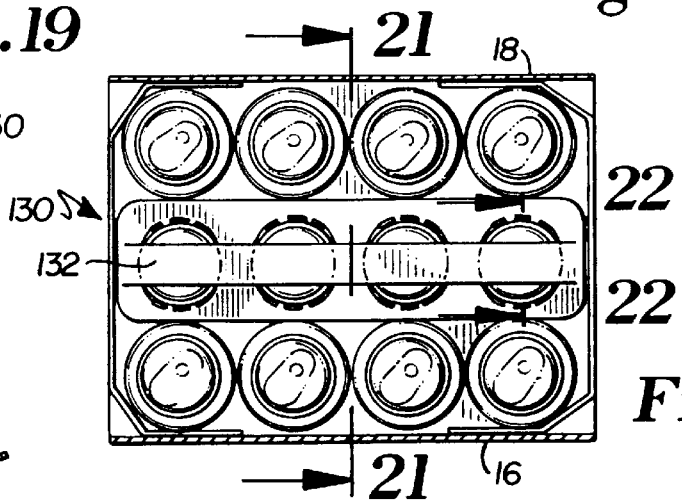
FIG. 20 is a partial top view of a partially assembled wrap-around article carrier formed from the blank of FIG. 18.
Figure 21:
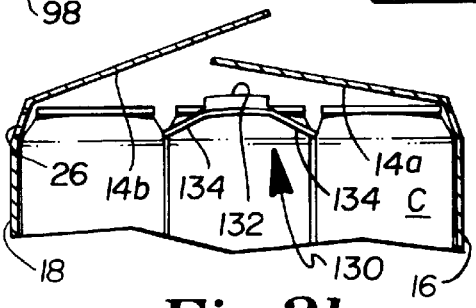
FIG. 21 is a cross-sectional view of a partially assembled wrap-around article carrier taken along line 21—21 of FIG. 20.
Figure 22:
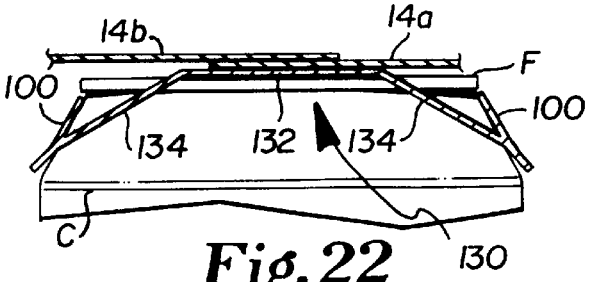
FIG. 22 is a partial cross-sectional view of the can clip in an assembled wrap-around article carrier taken along line 22—22 of FIG. 20.

The flat carrier blank 40*d* of FIG. 18, the can clip 130 of FIG. 19, and the views of FIGS. 20–22 illustrate another embodiment of the wrap-around article carrier of the present invention. The clip 130 forms an article holder and generally comprises a strap 132 and two bevel panels 134 connected to the strap 132 by fold lines 136. The bevel panels 134 contain can lock chimes 94 and form an article holder for contacting and supporting the tops of a row of cans within the carrier 12. Each can lock chime 94 approximates a semi-circular openings defined by an edge 96 along fold lines 136 and a peripheral edge 98. The peripheral edge 98 is cut and scored in a manner to form tabs 100 opposite from the diametric edge 96. Opposing chimes 94 are positioned across the strap 132 from each other 132 in a manner that the peripheral edges 98 partially form the circumference of a circle corresponding to the size of the flange of a can. The circumference of the circle is completed by arcuate score lines 138 that extend through the strap 132. These score lines 138 distribute stresses caused by folding the bevel panels 134 around the flange of a can.

To form a package 10 from the blank 40*d* of FIG. 18, twelve beverage cans are arranged into a product configuration comprising three rows and four columns as illustrated in FIG. 20, and are positioned on the bottom panel section 20. Prior to folding the top panel flap 14*a* over the cans C, the can clip 130 is placed over the center row of cans and the bevel panels 134 are clipped allowing the tabs 100 of the chimes 94 to engage or lock with the underside of the flange F of each can C in the center row. The top panel flap 14*a* is then folded an glued to the strap 132, and the top panel flap 14*b* is folded over and glued to the top panel flap 14*a* to compete the construction of the carrier 12 as illustrated in the cross-sectional view of FIG. 21 and the partial cross-sectional view of FIG. 22 across the clip 130.

Figure 23:
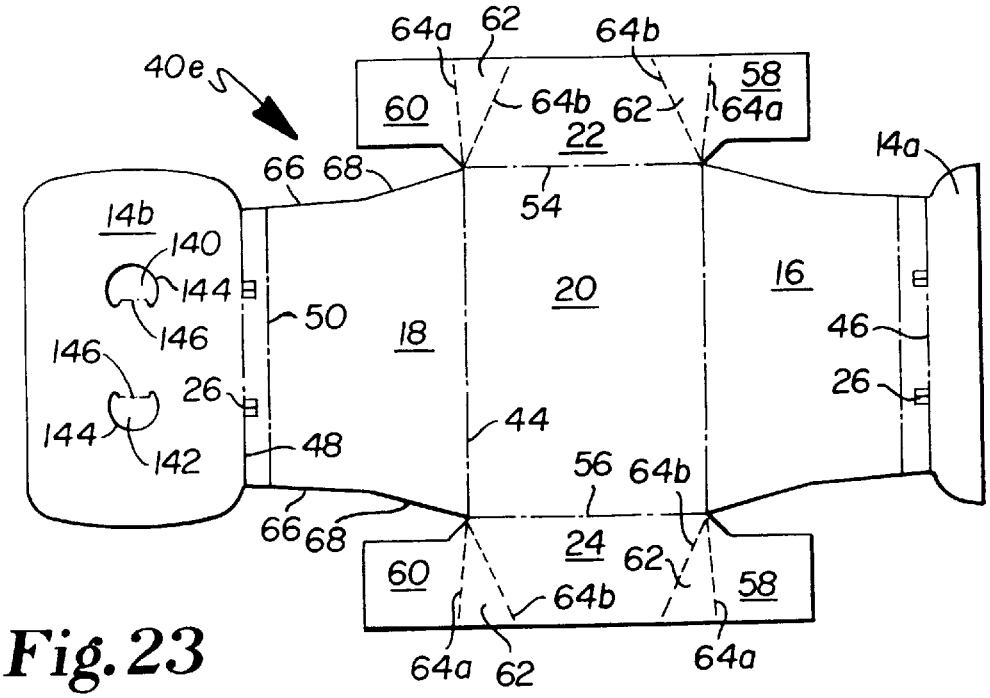
FIG. 23 is a plan view of a blank for forming the main wrap-around portion of another embodiment of the wrap-around article carrier of the present invention.
Figure 24:
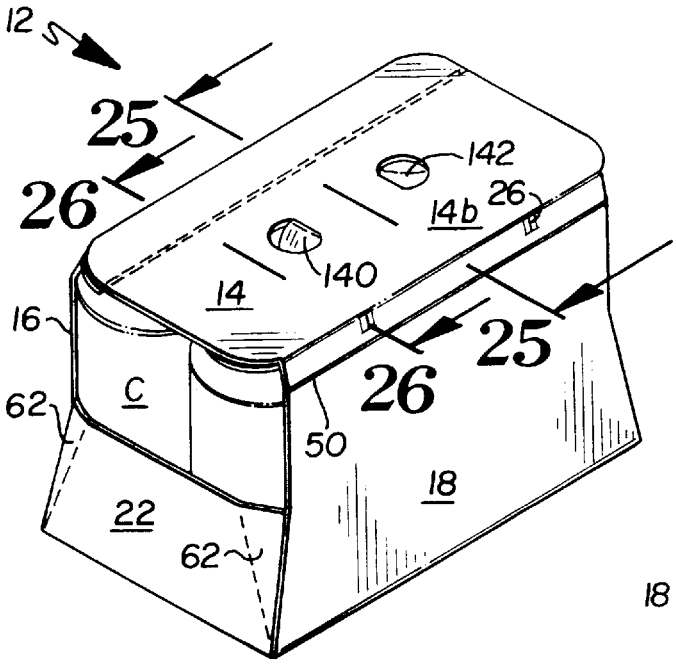
FIG. 24 is a perspective view of an assembled wrap-around article carrier formed from the blank of FIG. 23.
Figure 25:
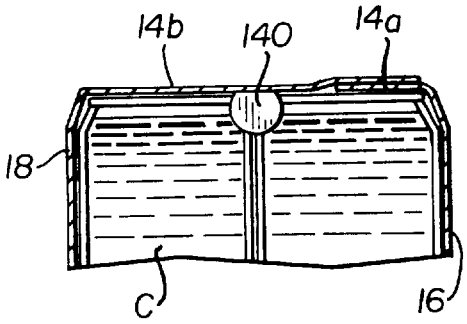
FIG. 25 is a partial cross-sectional view of the assembled wrap-around article carrier taken along line 25—25 of FIG. 24.
Figure 26:
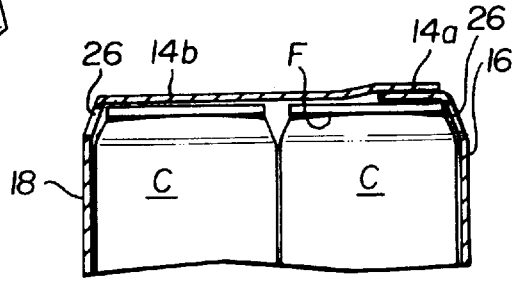
FIG. 26 is a partial cross-sectional view of the assembled wrap-around article carrier taken along lien 26—26 of FIG. 24.

The flat carrier blank 40*e* of FIG. 23 and the views of FIGS. 24–26 illustrate another embodiment of the wrap-around article carrier of the present invention. An article holder is formed by a pair of opposing tabs 140 and 142 defined by peripheral cuts 144 and fold lines 146 in the top panel flap 14*b*. The finger openings 148 left by the folded tabs 140 and 142 form the handle for this embodiment. To form a package 10 from the blank 40*e*, six beverage cans are arranged into a product configuration comprising two rows and three columns, and are positioned on the bottom panel section 20. The end panels 22 and 24 are folded upward and the corner tabs 60 and 58 are folded inward, and second, the side panels 16 and 18 are folded upward and glued to the tabs 58 and 60 to form all four bottom corners. The top panel 14*a* is folded over the cans C and the top panel 14*b* is folded over and glued onto the top panel 14*a* to compete the construction of the carrier 12 as illustrated in the perspective view of FIG. 24 and the cross-sectional views of FIGS. 25–26. A user will carry the package 10 by folding the opposing tabs 140 and 142, and in order to lift the package 10, will apply opposing pressure against the tabs 140 and 142 on each side of both cans in the middle column of the product configuration. The opposing pressure on the tabs 140 and 142 help secure the articles within the carrier.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A carrier, comprising:

(a) a bottom panel having opposing side edges;

(b) a first side panel and an opposing second side panel, each of said side panels having a top edge and an opposing bottom edge, said bottom edge of each of said side panels being connected to one of said side edges of said bottom panel;

(c) a top panel having opposing side edges, each of said side edges of said top panel being connected to one of said top edges of said side panels; and (d) wherein said carrier contains a product formation defined by adjacent rows and adjacent columns of articles, said side panels having at least one cutout, said at least one cutout having opposing tabs, said at least one cutout being aligned between adjacent columns of articles, said at least one cutout is positioned within a top margin of each of said side panels and said top margin of each of said side panels is formed by fold lines between said top panel and each of said side panels and a score line in each of said side panels.

2. The carrier of claim 1, wherein said first side panel further has a handle opening.

3. The carrier of claim 2, wherein said first side panel further has a plurality of stress-relieving score lines.

4. The carrier of claim 1, wherein said bottom panel has opposing end edges, said carrier further comprising a first end panel and an opposing end panel, each of said end panels having a bottom edge, said bottom edge of each of said end panels being connected to one of said end edges of said bottom panel, each of said end panels has a first tab and an opposing second tab, said first tabs being connected to said first side panels, said second tabs being connected to said second side panel and each of said end panels has a first bevel panel and a second bevel panel, said first bevel panel connecting said first tab to said end panel, said second bevel panel connecting said second tab to said end panel.

5. The carrier of claim 4, wherein each of said bevel portions is triangular, each of said side panels having opposing end edges, each of said end edges having an angled portion, said angled portion being positioned and oriented to align with an edge of said bevel portion.

6. The carrier of claim 4, wherein said end panels and said side panels have a predetermined height, said predetermined height of said end panels being less than said predetermined height of said side panels.

7. The carrier of claim 1, wherein said top panel includes a first top panel and a second top panel, said first top panel having a side edge attached to said top edge of said first side panel, said second top panel having a side edge attached to said top edge of said second side panel, said second top panel being overlapped and attached to said first top panel, said carrier further including an article holder connected to one of said top panels, said carrier containing a product configuration of a plurality of articles, each of said articles having a top and a bottom, said article holder being in contact with at least one of said article tops, and said article holder comprising a lock flap connected to said first top panel by a fold line, said lock flap having at least one chime.

8. The carrier of claim 7 wherein said article holder includes at least one chime adapted to receive an article top.

9. The carrier of claim 7 wherein said at least one chime is adapted to receive a top flange of a beverage can.

10. The carrier of claim 7 wherein said at least one chime is a semi-circular opening defined by a diametric edge and a peripheral edge, said opening being sized to receive a top of an article, said diametric edge being formed along said fold line defining said lock flap, said peripheral edge having at least one tab.

11. The carrier of claim 7, wherein said carrier contains twelve articles in a product configuration of three rows by four columns.

12. The carrier of claim 7, wherein said carrier contains a first row of articles and an adjacent second row of articles, said article holder being a v-clip lock flap connected to said first top panel flap by a first fold line, said v-clip lock flap comprising at least one chime adapted to receive at least one of said article tops in said first row and at least one chime adapted to receive at least one of said article tops in said second row.

13. The carrier of claim 12, wherein said v-clip lock flap comprises a first bevel panel connected to said first top panel by said first fold line, a second bevel panel connected to said first bevel panel by a second fold line, and a distal panel connected to said second bevel panel by a third fold line, at least one of said chimes being positioned in said first bevel panel and at least one of said chimes being positioned in said second bevel panel, each of said chimes being a semi-circular opening defined by a diametric edge and a peripheral edge, said opening being sized to receive a top of an article, said diametric edge of said chime positioned in said first bevel panel being formed along said first fold line and said diametric edge of said chime positioned in said second bevel panel being formed along said second fold line, said peripheral edge of each of said chimes having at least one tab.

14. The carrier of claim 12, wherein said carrier contains twelve articles in a product configuration of three rows by four columns, said v-clip lock flap being in contact with at least one article in each of two of the three rows in said product configuration.

15. The carrier of claim 12, wherein said carrier contains twenty-four articles in a product configuration of four rows by six columns, said v-clip lock flap being in contact with at least one article in the middle two rows in said product configuration.

16. The carrier of claim 7, wherein said article holder is a can clip having a strap connected to opposing bevel portions by fold lines, each of said bevel portions having at least one chime, said chime being an opening defined by a straight edge and a peripheral edge, said straight edge being formed along said fold line, said peripheral edge having at least one tab, said strap being attached to said first top panel of said carrier.

17. The carrier of claim 16, wherein said carrier contains twelve articles in a product configuration of three rows by four columns, said can clip having four opposing pairs of chimes, each of said chimes being in contact with the center row of the product configuration.

18. The carrier of claim 7, wherein said article holder is positioned in said second top panel, said article holder comprising a pair of opposing tabs formed by two cutouts in said second top panel, said tabs being connected to said second top panel by fold lines.

19. The carrier of claim 18, wherein said carrier contains six articles in a product configuration of two rows by three columns, one of said tabs being positioned between said two rows and between a first and a second column, and the other one of said tabs being positioned between said two rows and between said second column and a third column.

20. A wrap-around beverage can carrier containing a product formation defined by adjacent rows and adjacent columns of cans, each of said cans having a top flange, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout, said at least one cutout having opposing tabs, said at least one cutout being aligned between adjacent columns of articles, said first side panel having a handle opening;

(c) a first end panel and an opposing second end panel, each of said end panels having a bottom edge, said bottom edge of each of said end panels being connected to one of said end edges of said bottom panel, each of said end panels further having a first tab and an opposing second tab, said first tabs being connected to said first side panel, said second tabs being connected to said second side panel, each of said end panels further having a first bevel panel and a second bevel panel, said first bevel panel connecting said first tab to said end panel, said second bevel panel connecting said second tab to said end panel;

(d) a top panel, said top panel including a first top panel and a second top panel, said first top panel having a side said first top panel having a side edge attached to said top edge of said first side panel, said second top panel having a side edge attached to said top edge of said second side panel, said second top panel being overlapped and attached to said first top panel; and (e) an article holder connected to said top panel, said article holder being in contact with said top flange of at least one of said cans.

21. A flat blank for forming an article carrier, comprising:

(a) a bottom panel having opposing side edges and further having opposing end edges;

(b) a first side panel and an opposing second side panel, each of said side panels having a top edge and an opposing bottom edge, said bottom edge of each of said side panels being connected to one of said side edges of said bottom panel;

(c) a first top panel and a second top panel, said first top panel having a side edge attached to said top edge of said first side panel, said second top panel having a side edge attached to said top edge of said second side panel, said second top panel adapted to be overlapped and attached to said first top panel in an article carrier formed from said flat blank; and (d) a first and panel and an opposing second end panel, each of said end panels having a bottom edge, said bottom edge of each of said end panels being connected to one of said end edges of said bottom panel, each of said end panels having a first tab and an opposing second tab, and each of said end panels further having a first bevel panel and a second bevel panel, said first bevel panel connecting said first tab to said end panel, and said second bevel panel connecting said second tab to said end panel.

22. The flat blank of claim 21, wherein said first side panel has a handle opening.

23. The flat blank of claim 21, wherein said side panels have at least one cutout adjacent to said top edge, said at least one cutout having opposing tabs.

24. The flat blank of claim 21, further comprising an article holder attached to one of said top panels, said article holder having a form to engage and secure at least one article top in an assembled article carrier.

25. The flat blank of claim 24, wherein said article holder is a lock flap connected to said first top panel by a fold line, said lock flap having at least one chime.

26. The flat blank of claim 24, wherein said article holder is a v-clip lock flap connected to said first top panel by a first fold line, said v-clip lock flap having at least, one chime adapted to receive at least one of said article tops in a first row and at least one chime adapted to receive at least one of said article tops in a second row.

27. The flat blank of claim 24, further including a can clip, said can clip comprising a strap connected to opposing bevel portions by fold lines, each of said bevel portions having at least one chime, said chime being an opening defined by a straight edge and a peripheral edge, said straight edge being formed by said fold line, said peripheral edge having at least one tab, said strap being attached to said first top panel.

28. The flat blank of claim 24, wherein said article holder is positioned in said second top panel, said article holder comprising a pair of opposing tabs formed by two cutouts in said second top panel, said tabs being connected to said second top panel by fold lines.

29. A flat carrier blank for forming a beverage can carrier, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout adjacent to said top edge, said at least one cutout having opposing tabs, said first side panel having a handle opening;

(c) a first top panel and a second top panel, said first top panel having a side edge attached to said top edge of said first side panel, said second top panel having a side edge attached to said top edge of said second side panel, said second top panel adapted to be overlapped and attached to said first top panel in a beverage can carrier formed from said flat carrier blank;

(d) a first end panel and an opposing second end panel, each of said end panels having a bottom edge, said bottom edge of each of said end panels being connected to one of said end edges of said bottom panel, each said end panels having a first tab and an opposing second tab and further having a first bevel panel and a second bevel panel, said first bevel panel connecting said first tab to said end panel, said second bevel panel connecting said second tab to said end panel; and (e) an article holder attached to one of said top panels, said article holder having a form to engage and secure tops of cans contained by an assembled article carrier.

* * * * *